US005280923A

United States Patent [19]

Lu

[11] Patent Number: 5,280,923

[45] Date of Patent: Jan. 25, 1994

[54] GOLF CLUB DESIGN

[76] Inventor: Clive S. Lu, 282 Newbridge Rd., Hicksville, N.Y. 11801

[21] Appl. No.: 944,099

[22] Filed: Sep. 11, 1992

[51] Int. Cl.[5] ..... A63B 53/02

[52] U.S. Cl. ..... 273/80.2; 273/80 A; 273/167 H

[58] Field of Search ..... 273/80.2-80.9, 273/167 R-77 A, 80 A, 80 C

[56] References Cited

U.S. PATENT DOCUMENTS

| | | | |
|---|---|---|---|
| 1,568,888 | 1/1926 | Dunn | 273/167 H |
| 2,361,415 | 10/1944 | Reach | 273/80.5 |
| 3,693,978 | 9/1972 | East | 273/80 C X |
| 3,810,621 | 5/1974 | Mills | 273/80.2 |
| 4,438,931 | 3/1984 | Motomiya | 273/167 H |
| 4,890,840 | 1/1990 | Kobayashi | 273/167 H |
| 4,919,431 | 4/1990 | Antonious | 273/167 H X |
| 5,039,098 | 8/1991 | Pelz | 273/80.1 |
| 5,042,806 | 8/1991 | Helmstetter | 273/167 H X |
| 5,067,715 | 11/1991 | Schmidt et al. | 273/167 H X |
| 5,149,091 | 9/1992 | Okumoto et al. | 273/167 K X |

FOREIGN PATENT DOCUMENTS

| | | | |
|---|---|---|---|
| 2225725 | 6/1990 | United Kingdom | 273/167 H |

*Primary Examiner*—Jessica J. Harrison
*Assistant Examiner*—Sebastiano Passaniti
*Attorney, Agent, or Firm*—King & Schickli

[57] ABSTRACT

A golf club is provided including a club head having a toe portion, a heel portion including a shaft receiving bore, a face for striking a golf ball, a center of gravity and a sole. The shaft includes a proximal end and a distal end. The distal end is received in the shaft receiving bore of the heel portion of the club head. A grip is connected to the proximal end of the shaft. The connection of the shaft and club head is characterized by the shaft having a distal end or tip that is cut at an angle of between 5° and 85° and more preferably 30° and 45° relative to a longitudinal axis of the shaft. Similarly, the shaft receiving bore is blind and includes a bottom wall adjacent the sole of the club head. This bottom wall extends at an angle to a longitudinal axis of the bore matching the distal end or cut angle of the shaft. Further, the bottom wall of the bore is positioned vertically below a plane extending through the center of gravity of the club head and parallel to the ground when the club head is positioned to strike a golf ball with the sole resting on the ground. A method for producing the golf club is also provided.

17 Claims, 2 Drawing Sheets

GOLF CLUB DESIGN

TECHNICAL FIELD

The present invention relates generally to the field of golf and, more particularly, to an improved design for a golf club and a method of producing the same.

BACKGROUND OF THE INVENTION

Golf is a skill sport wherein the constant goal is a level of improved play. Such a level may be achieved in two ways. The first is by improving the ability and skill of the individual golfer. The second is by improving the performance of the equipment including not only the golf balls but also the golf clubs used to strike the balls. This invention relates to the desire to provide improved golf clubs exhibiting enhanced performance including greater accuracy and hitting distance as well as improved "feel" that allows for better control of the flight of the ball by the player.

The desire to provide golf clubs exhibiting enhanced performance and accordingly, a competitive edge has been a driving force in the golf club industry for years. Improvements in the design of golf clubs include cavity backed irons to provide a better weight distribution and larger sweet spot for striking the ball and "metal woods" that allow a better weight distribution and presentation of a larger sweet spot for increases in both directional accuracy and driving distance.

Despite a large number of significant advances having been made in golf club design over the years, further improvements in performance are still desired and are possible. In this regard, one area of golf club design in ready need of improvement is the coupling between the shaft of the club and the club head. It is this aspect of golf club design to which the present invention relates.

SUMMARY OF THE INVENTION

Accordingly, a primary object of the present invention is to provide a golf club of unique design and relatively simple and inexpensive construction that exhibits significantly improved performance including enhancements in driving distance and directional accuracy.

Yet another object of the present invention is to provide an unique structural arrangement for connecting the shaft to the head of a golf club that is equally applicable to clubs of both the "wood" and "iron" types. The structural arrangement also provides better "feel" when striking a golf ball. This advantageously allows the player a competitive advantage by enhancing his or her ability to "work" or control the resulting flight of a golf shot.

Yet another object of the present invention is to provide a method of manufacturing a golf club exhibiting these improvements in performance characteristics.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a golf club of unique design is provided. As should be appreciated, the golf club comprises a club head having a toe portion, a heel portion including a shaft receiving bore, a face for striking a golf ball and a sole. As is known in the art, the club head defines a center of gravity which effectively functions as a "sweet spot". When the club head travels along the target line and strikes a golf ball at the sweet spot, the ball flies straight and true on its intended path for the maximum possible distance for any given swing being produced. For purposes of the present invention, a club head is defined as including designs of both the "iron" and "wood" type formed of any material known in the art for these purposes and formed in accordance with any known production methods.

The golf club also includes a flexible shaft formed from stainless steel, titanium, graphite-boron or any other material known in the art to be appropriate for this purpose. A distal end of the shaft is received in a shaft receiving bore in the heel portion of the club head. A grip, formed of rubber, leather or any other appropriate material as is known in the art, is connected to the proximal end of the shaft.

In accordance with an important aspect of the present invention the distal end or tip of the shaft is cut at an angle between 5° and 85° and more preferably 30° and 45° relative to the longitudinal axis of the shaft. The shaft receiving bore in the club head includes a bottom wall adjacent the sole of the club head. This bottom wall extends at an angle to a longitudinal axis of the bore matching the distal end or tip of the shaft (i.e. between 30° and 45°). Further, the bottom wall is positioned at or vertically below a plane extending through the center of gravity of the club head and parallel to the ground when the club head is positioned to strike a golf ball with the sole of the club head resting on the ground. For golf clubs of the iron type the shaft extends from the club head at a lie angle of approximately 56° to 63° with respect to the ground. For golf clubs of the wood type the shaft extends from the club head at a lie angle of approximately 56° to 57° with respect to the ground.

Advantageously, when the shaft is fully inserted into the bore, the angular end of the shaft and the matching angular bottom wall of the bore seat together to positively prevent any relative rotation between the shaft and the club head. Further, it must be appreciated that the distance between the end of the shaft and the center of gravity of the club head is effectively reduced from prior art designs. Accordingly, the resulting moment arm defined between the two is shortened and, therefore, the torque produced when striking a golf ball is reduced. As a result, directional control is significantly enhanced so as to provide the player utilizing the golf club with a distinct competitive advantage.

In accordance with a further aspect of the present invention, the distance between the bottom wall of the shaft receiving bore and the face of the sole of the club head is between only approximately 0.070 and 0.075 inches. Accordingly, it should be appreciated that the shaft sits way down in the club head effectively as far as possible while still maintaining the positive lock against rotation provided by the seating of the angular shaft tip against the bottom wall of the bore. As a result, the hosel or neck extending upwardly from the club head and adapted for receiving the shaft may be shortened to between only 1 and 1.25 inches in length. This is significantly shorter than on many golf clubs of state of the art design.

Advantageously, the weight of material normally utilized to form a longer hosel in these designs may be repositioned directly in line with the center of gravity of the golf club. This enhances the impact power of the sweet spot so as to allow increased driving distances to be achieved. Further, as this is achieved without increasing the overall weight of the golf club, there is no reduction in swing velocity from added weight that counters any resulting advantage gained from aligning that weight with the center of gravity.

In accordance with a further aspect of the present invention, a method is provided for attaching a golf club head to a shaft. The method includes the step of providing a golf club head with a toe portion, a heel portion including a shaft receiving bore, a face for striking a golf ball, a center of gravity and a sole. Next is the providing of a shaft including a proximal end and a distal end. As already described, the distal end is received in a shaft receiving bore in the heel portion of the club head. The method then further includes the step of cutting the distal end or tip of the shaft at an angle between 5° and 85° and more preferably 30° and 45° relative to the longitudinal axis of the shaft. Additionally, the shaft receiving bore is formed with a bottom wall adjacent the sole of the club head extending at an angle to a longitudinal axis of the bore matching the cut angle of the top of the shaft. The method then further includes the positioning of the shaft fully within the shaft receiving bore so that the end of the shaft engages the bottom wall of the bore. An adhesive of a type known in the art, such as epoxy, may be utilized for completing the connection.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Figure 1:
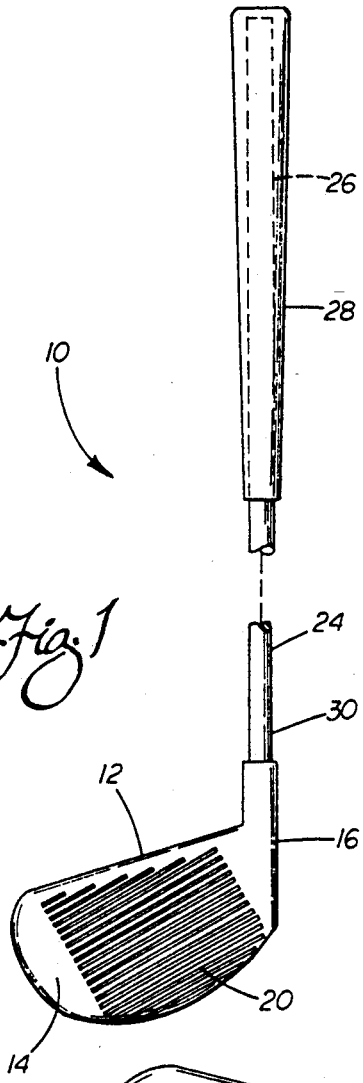
FIG. 1 is a partially cutaway, front elevational view of a golf club of the "iron" type constructed in accordance with the teachings of the present invention.

Reference will now be made in detail to the present preferred embodiment of the invention, an example of which is illustrated in the accompanying drawing.

DETAILED DESCRIPTION OF THE INVENTION

Reference is now made to the drawing figures showing the improved golf club 10 of the present invention. As shown in FIGS. 1–3 and 4–5, respectively, the golf club 10 includes a club head 12 of either the "iron" or "wood" type. As shown, in FIGS. 1–3, the club head 12 includes a toe portion 14, a heel portion 16 including a shaft receiving bore 18, and a face 20 for striking a golf ball. The club head 12 also includes a center of gravity, designated by the reference letter G and a sole 22 for resting/contacting the ground during use.

As further shown in FIG. 1, the golf club 10 includes a shaft of appropriate flexibility formed from titanium, graphite-boron, stainless steel or other appropriate material known in the art. The shaft 24 includes a proximal end 26. A handle or grip 28 of a type of construction known in the art is received over and mounted to the proximal end 26 of the shaft 24. As described in greater detail below, the distal end 30 of the shaft 24 is received in the shaft receiving bore 18 in the heel 16 and hosel 19 of the club head 12.

Figure 3:
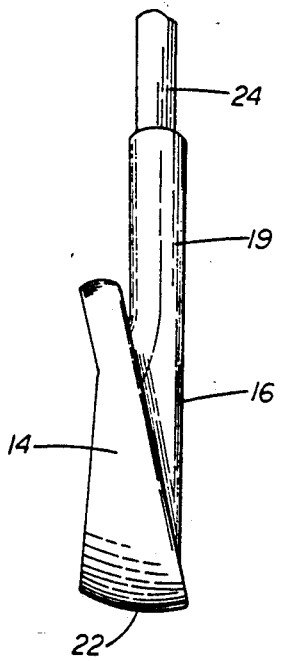
FIG. 3 is a partially sectional view of the golf club of the present invention shown in FIG. 1 illustrating the connection of the shaft in the club head.

As best shown in FIG. 3, the tip 32 of the distal end 30 of the shaft 24 is cut at an angle of between 30° and 45° relative to a longitudinal axis L of the shaft. Similarly, the shaft receiving bore 18 is formed so as to include a bottom wall 34 adjacent the sole 22 of the club head 12 that extends at an angle to the longitudinal axis of the bore that matches the angle of the tip 32 of the shaft 24 (e.g. between 5° and 85° and more preferably 30° and 45°). Of course, when assembled, it should be appreciated that the longitudinal axis of the shaft 24 and the bore 18 are shared. Further, as shown, the bottom wall 34 is positioned at or vertically below a plane P extending through the center of gravity of the club head 12 and parallel to the ground D when the club head 12 is positioned to strike a golf ball with the sole 22 resting on the ground. When so positioned, the shaft 24 of the "iron" type club head 12 extends at a lie angle between 56° and 63°. The shaft of the "wood" type club head 12 extends at a lie angle between 56° and 57°.

A number of advantages result from the structure being described for connecting the shaft 24 to the club head 12. First, it should be appreciated that when the shaft 24 is fully inserted into the shaft receiving bore 18, the tip 32 meshes with and seats against the bottom wall 34. This meshing positively prevents any relative rotation between the shaft 24 and club head 12 upon the striking of a golf ball. Accordingly, the torque produced by this event is evenly distributed through the shaft 24 and transmitted to the golfer through the grip 28. Further, this is effectively achieved without any loss of force such as occurs in prior art club designs wherein the tip of the shaft is cut at an angle perpendicular to the longitudinal axis of the shaft.

More particularly, in such a prior design, there is no structure to positively prevent rotation. Accordingly, only the epoxy holding the shaft within the club head serves this function. As no epoxy is perfect and all include some give, there is a loss of force. This translates into a loss of feel. Advantageously, it is this loss of feel that is substantially avoided with the present structural arrangement so as to provide the golfer with better shot control and increased confidence. This increased confidence translates into a significant competitive advantage when playing from difficult lies or preparing to execute difficult shots requiring a controlled draw or fade to be placed upon the golf ball.

It should further be appreciated that by providing the lowermost point of contact between the shaft 24 and the bore 18 in the club head 12 at or vertically below the plane P, the shortest possible moment arm M is provided between the center of gravity G of the club head 12 and the shaft 24. As a result, less overall torque is produced upon impact. Advantageously, this reduction in torque reduces the likelihood of the shaft 24 and grip 28 rotating or spinning in the hands of the golfer at the time of contact with the golf ball. As even the slightest rotation of the golf club 10 during the execution of a shot can lead to the application of unwanted spin and the ball flying off the desired target line, this is a critically important advantage that significantly enhances shot accuracy. Accordingly, once again it should be appreciated that the golf club of the present invention improves the golfer's performance, thereby increasing the golfer's confidence to his or her further benefit.

Still further, it should be appreciated that the angular tip 32 forms an elliptical edge of increased area for mating with the bottom wall 34 of the bore 18 when compared with a shaft 24 cut at a perpendicular angle and forming a circular edge of contact. Additionally, as the shaft 24 extends downwardly through the club head 12 to the sole 22; that is, within 0.1 and more preferably, between 0.070 and 0.075 inches of the bottom face, a significant area of contact is provided within the profile of the club head itself. This added area of contact allows for good adhesive bonding between the shaft and the club head utilizing standard epoxy while also allowing the hosel 36 to be made shorter. Advantageously, as a shorter hosel 36 may be made from less material, the hosel is of a lighter overall weight.

The present invention takes advantage of this weight savings by positioning a weight equivalent to the weight savings in the area of the center of gravity G of the club head 12. Accordingly, when compared with present state of the art designs, the golf club 10 of the present invention has the same overall weight and, therefore, may be swung with the same club head velocity. The weight, however, is more in line with the center of gravity G of the club head 12 to produce longer, straighter, on-line shots. In contrast, prior art club designs including a heavier hosel have this additional weight off-line from the center of gravity. Accordingly, the weight is not fully utilized to the benefit of the golfer in driving the ball forward. Further, the off-line positioning of the weight actually promotes twisting of the club head at the time of impact, often resulting in a mistargeted shot.

Figure 2:
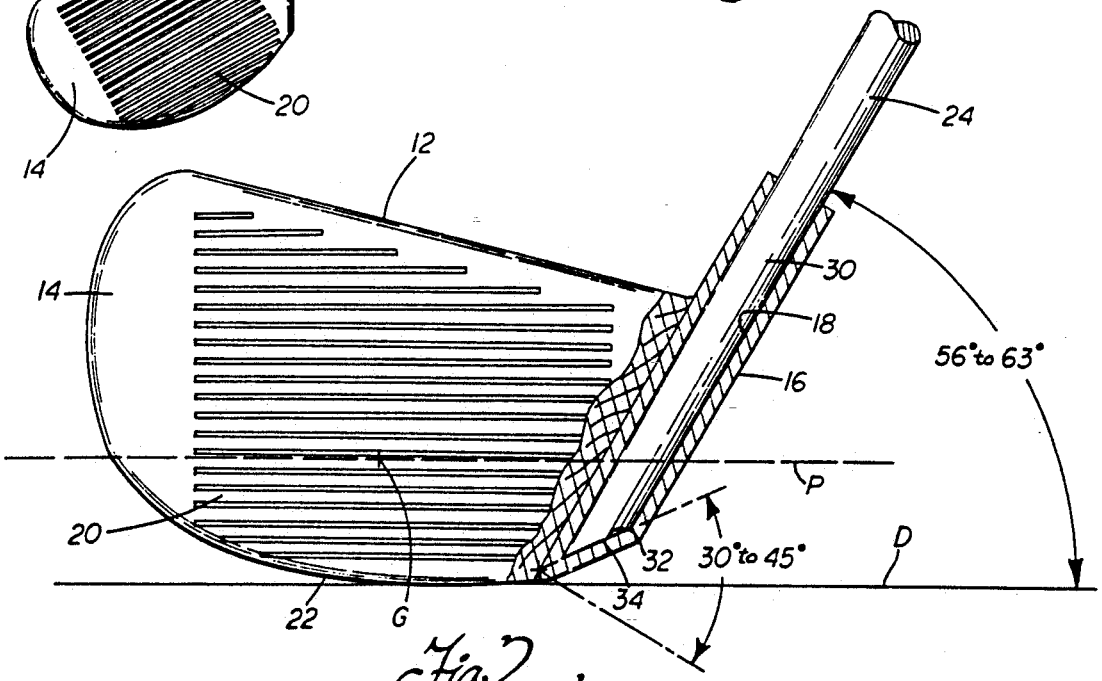
FIG. 2 is a fragmentary side elevational view of the club head shown in FIG. 1.

Irons including a club head 12 of the type described and shown in FIGS. 1-3 are preferably formed from stainless steel, beryllium cooper or other appropriate material utilizing the investment casting method. During casting an angled ceramic shaft (not shown) is utilized as a core to make the wax shell. This allows the formation of the bottom wall 34 of the bore 18 to the desired angle to receive and seat the angular shaft tip 32 in the manner previously described.

Figure 4:
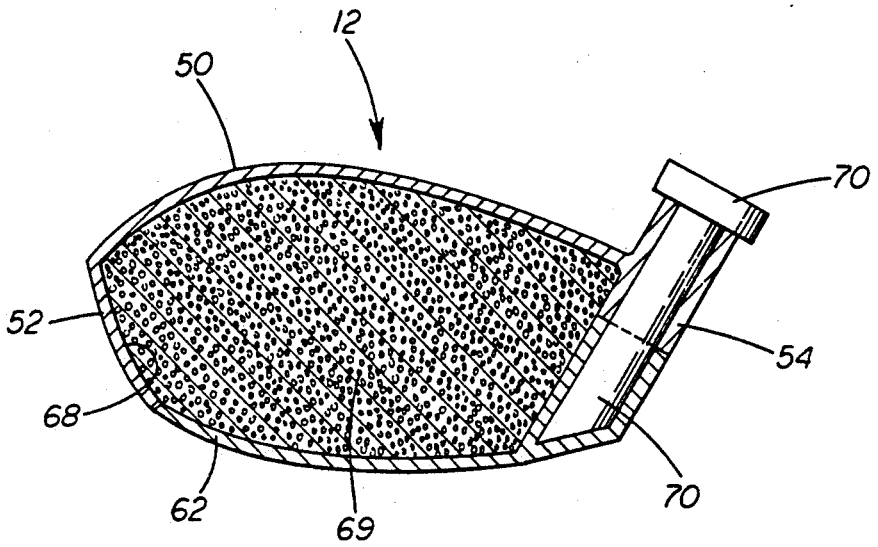
FIG. 4 is a sectional view showing the pin utilized to hold the shell and sole plate of a "wood" type club head properly aligned during welding.
Figure 5:
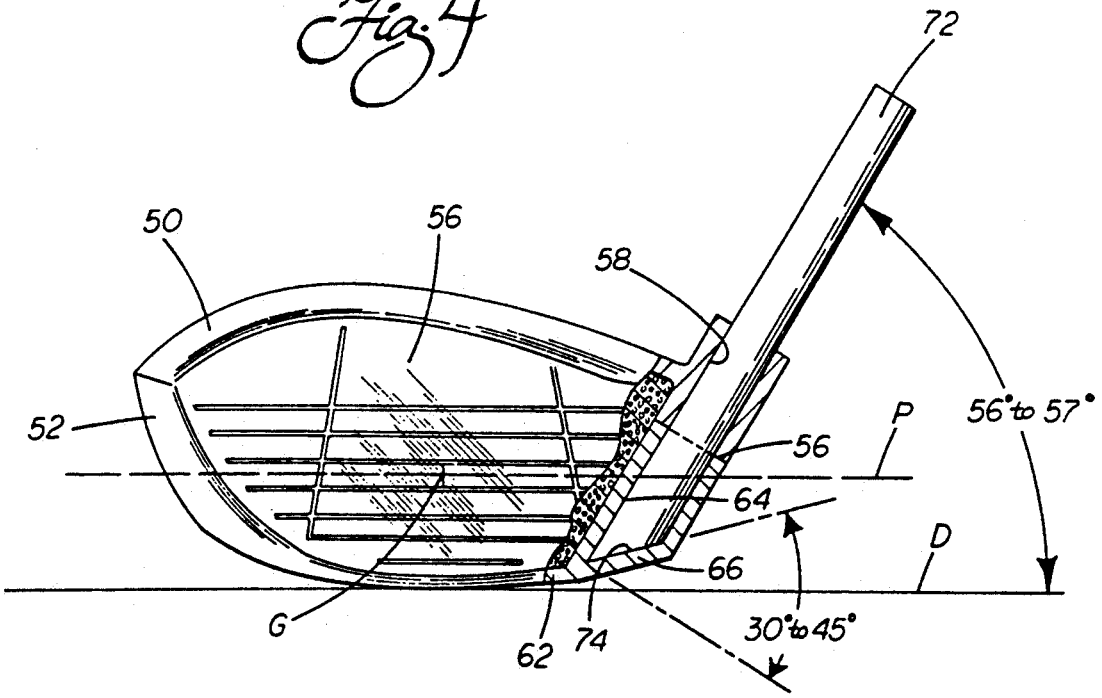
FIG. 5 is a partially sectional view similar to FIG. 4 showing the shaft fully inserted into the bore of the club head.

Woods including a club head 12 of the type described and shown in FIGS. 4 and 5 are preferably formed from stainless steel or other appropriate material by the investment casting method. More preferably each club head 12 includes an upper shell 50 having a toe portion 52, a heel portion 54 and a face 56 for striking the golf ball. As shown, the heel portion 54 includes a shaft receiving bore 58 and a low profile hosel 60. Each club head 12 also includes a sole plate 62. As shown, the sole plate 62 includes a socket 64 forming the bottom wall 66 of the shaft receiving bore 58. The bottom wall 66 is provided at or vertically below a plane P running through the center of gravity G and parallel to the ground in the same manner as described above with respect to the golf clubs of the "iron" type.

During production, the sole plate 62 is welded to the shell 50 with the cavity 68 formed therebetween filled with a foam material such as polyurethane 69. In order to insure proper alignment between the socket 64 of the sole plate 62 and the shaft receiving bore 58 and hosel 60 of the shell portion 50 during the welding operation, a pin 70 is positioned through the bore and into the socket (see FIG. 4). After welding is completed, the pin 70 is removed and the shaft 72 is inserted fully into the bore 58 and socket 64. The shaft 72 includes a tip 74 cut at an angle between 5° and 85° and more preferably 30° and 45° to match and seat against the bottom wall 66 of the socket 64. Epoxy is utilized to secure the shaft 72 in the bore 58 and socket 64 of the club head 12 in the manner already described with respect to the "iron" type club head 12.

In summary, numerous benefits result from employing the concepts of the present invention. The golf club 10 includes a unique structural connection between the club head 12 and shaft 24 that allows better overall weight distribution for promoting longer, straighter and more accurate shot playing. Additionally, the connection effectively reduces the torque generated at impact with the golf ball so as to reduce the tendency of the club to twist and place unwanted spin on the ball. This further improves directional accuracy. Further, this is achieved while transmitting substantially all of the torque that is produced without any substantial loss evenly through the shaft 24 and grip 28 to the golfer. This provides the golfer with improved "feel" to allow the golfer to control the shot with confidence.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, rather than being cut all the way across, the shaft could be cut part way across, at any of the angles indicated, so as to meet in the middle and form a point. In effect, any cutting of the shaft to provide positive seating in the shaft receiving bore so as to prevent relative rotation of the shaft is encompassed by the present invention.

The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A golf club comprising:

a club head having a toe portion, a heel portion including a shaft receiving bore having a bottom wall closing one end, a face for striking a golf ball, a center of gravity and a sole;

a shaft including a proximal end and a distal end, said distal end being received in said shaft receiving bore of said heel portion of said club head;

a grip connected to said proximal end of said shaft;

means for adhesively bonding said club head and shaft together;

said golf club being characterized by said distal end of said shaft being cut at an angle of between 5° and 85° relative to a longitudinal axis of said shaft and said bottom wall of said shaft receiving bore being adjacent said sole of said club head and extending at an angle to a longitudinal axis of said bore which matches said angle of said distal end of said shaft, said bottom wall further being positioned vertically below a plane extending through said center of gravity of said club head and parallel to said ground when said club head is positioned to strike a golf ball with said sole resting on the ground, said club head and shaft being free of any pin/screw fastener; whereby engagement of said distal end of said shaft with said bottom wall prevents twisting of said club head on said shaft without provision of any pin/screw fastener.

2. The golf club set forth in claim 1, wherein the distance between said bottom wall of said shaft receiving bore and the face of said sole is between 0.070 and 0.075 inches.

3. The golf club set forth in claim 1, wherein the distance between said bottom wall of said shaft receiving bore and the face of said sole is less than 0.1 inches.

4. The golf club set forth in claim 1, wherein the distance between said plane and a bottommost portion of said shaft receiving bore is between 1.0 and 1.25 inches.

5. The golf club set forth in claim 1, wherein the distance between said plane and a bottommost portion of said shaft receiving bore is 1.125 inches.

6. The golf club set forth in claim 1, further including a hosel extending upwardly from said club head and including a portion of said shaft receiving bore, said hosel being between 1 and 1.25 inches in length.

7. The golf club set forth in claim 1, wherein said distal end of said shaft is cut at an angle of between 30° and 45° relative to said longitudinal axis of said shaft.

8. A golf club comprising:

a club head having (a) an upper shell including a toe portion, a heel portion and a hosel both including a shaft receiving bore having a bottom wall closing one end an a face portion for striking a golf ball and (b) a sole plate including a socket, said upper shell and sole plate being connected together with said shaft receiving bore and socket in alignment;

a shaft including a proximal end and a distal end, said distal end, being cut at an angle between 5° and 85° relative to a longitudinal axis of said shaft, said socket including a bottom wall extending at a matching angle so that said distal end of said shaft is received in said shaft receiving bore and said socket so as to abutt said bottom wall, said club head and said shaft being free of any pin/screw fastener whereby twisting of said club head on said shaft is prevented without provision of any pin/-screw fastener; and a grip connected to said proximal end of said shaft.

9. The gold club set forth in claim 8, wherein said distal end of said shaft is cut at an angle of between 30° and 45° relative to said longitudinal axis of said shaft.

10. A method of connecting a golf club head and shaft, comprising the steps of:

providing a golf club head with a toe portion, a heel portion including a shaft receiving bore, a face for striking a golf ball, a center of gravity and a sole;

providing a shaft including a proximal end and a distal end, said distal end being received in said shaft receiving bore of said golf club head;

cutting said distal end of said shaft at an angle between 5° and 85° relative to a longitudinal axis of said shaft;

forming a bottom wall to close one end of said shaft receiving bore adjacent said sole of said golf club head at an angle to a longitudinal axis of said bore which matches said angle of said distal end of said shaft; and positioning said distal end of said shaft fully within said shaft receiving bore of said golf club head with said angular end of said shaft seated against said bottom wall of said shaft receiving bore whereby engagement of said distal end of said shaft with said bottom wall prevents twisting of said club head on said shaft without provision of any pin/screw fastener.

11. The method set forth in claim 10, including connecting a grip to said proximal end of said shaft.

12. The method set forth in claim 10, including securing said shaft in said shaft receiving bore of said golf club head with adhesive.

13. The method set forth in claim 10 including providing said bottom wall of said shaft receiving bore vertically below a plane extending through said center of gravity of said golf club head and parallel to said ground when said club head is positioned to strike a golf ball with said sole resting on the ground.

14. The method set forth in claim 10 wherein the distance between said bottom wall of said shaft receiving bore and the face of said sole is less than 0.1 inches.

15. The method set forth in claim 10, wherein said distal end of said shaft is cut at an angle of between 30° and 45° relative to said longitudinal axis of said shaft.

16. A method of connecting a golf club head and shaft, comprising the steps of:

providing a golf club head with (a) an upper shell including a toe portion, a heel portion and a hosel both including a shaft receiving bore and a face for striking a golf ball and (b) a sole plate including a socket;

connecting said upper shell and sole plate together with said shaft receiving bore and socket in alignment;

providing a shaft including a proximal end and a distal end, said distal end being received in said shaft receiving bore and socket of said golf club head;

cutting said distal end of said shaft at an angle between 5° and 85° relative to a longitudinal axis of said shaft;

forming a bottom wall to close one end of said socket at an angle matching said angle of said distal end of said shaft;

positioning said distal end of said shaft fully within said shaft receiving bore of said golf club head with said angular end of said shaft seated against said bottom wall of said socket whereby engagement of said distal end of said shaft with said bottom wall prevents twisting of said club head on said shaft without provision of any pin/screw fastener; and adhesively bonding said golf club head and shaft together.

17. The method set forth in claim 16, wherein said distal end of said shaft is cut at an angle of between 30° and 45° relative to said longitudinal axis of said shaft.

* * * * *